US005297615A

United States Patent [19]

Aimone et al.

[11] Patent Number: 5,297,615

[45] Date of Patent: Mar. 29, 1994

[54] COMPLAINT INVESTMENT CASTING MOLD AND METHOD

[75] Inventors: Paul R. Aimone, Muskegon; Bart M. Kilinski; Keith D. Ramthun, both of Montague, all of Mich.

[73] Assignee: Howmet Corporation, Greenwich, Conn.

[21] Appl. No.: 916,015

[22] Filed: Jul. 17, 1992

[51] Int. Cl.[5] ..... B22C 1/02; B22C 9/04

[52] U.S. Cl. ..... 164/519; 164/361

[58] Field of Search ..... 164/519, 361

[56] References Cited

U.S. PATENT DOCUMENTS

| | | | |
|---|---|---|---|
| 2,806,270 | 9/1957 | Shaul | 164/518 |
| 3,125,787 | 3/1964 | Lirones et al. . | |
| 3,126,597 | 3/1964 | Operhall et al. . | |
| 3,239,897 | 3/1966 | Lirones . | |
| 3,241,200 | 3/1966 | Lirones . | |
| 3,296,666 | 1/1967 | Lirones . | |
| 3,305,358 | 2/1967 | Lirones . | |
| 3,362,463 | 1/1968 | Manginelli . | |
| 3,367,393 | 2/1968 | Lenahan et al. | 164/519 |
| 3,903,950 | 9/1975 | Lirones | 164/518 |
| 3,933,190 | 1/1976 | Fassler et al. . | |
| 4,086,311 | 4/1978 | Huseby et al. . | |
| 4,097,291 | 6/1978 | Huseby et al. . | |
| 4,164,424 | 8/1979 | Klug et al. . | |
| 4,188,450 | 2/1980 | Greskovich . | |
| 4,191,721 | 3/1980 | Pasco et al. . | |
| 4,196,769 | 4/1980 | Feagin . | |
| 4,216,815 | 8/1980 | Feagin . | |
| 4,221,748 | 9/1980 | Pasco et al. . | |
| 4,247,333 | 1/1981 | Ledder et al. . | |
| 4,316,498 | 2/1982 | Horton . | |
| 4,533,394 | 8/1985 | Watts . | |
| 4,557,316 | 12/1985 | Takayanagi et al. . | |
| 4,617,977 | 10/1986 | Mills . | |
| 4,655,276 | 4/1987 | Bird et al. | 164/519 |
| 4,664,172 | 5/1987 | Takayanagi et al. . | |
| 4,689,081 | 8/1987 | Watts . | |
| 4,947,926 | 8/1990 | Ogino et al. . | |
| 4,966,225 | 10/1990 | Johnson et al. . | |

*Primary Examiner*—Kuang Y. Lin

*Attorney, Agent, or Firm*—Flynn, Thiel, Boutell & Tanis

[57] ABSTRACT

A high melting point and/or low ductility metal or alloy is investment cast in a refractory mold including a facecoat layer and a plurality of back-up layers wherein at least one back-up layer is a relatively weak, sacrificial layer. This latter layer is crushed as necessary as the casting cools below its ductile-to-brittle transition temperature to avoid hot tearing or cracking of the solidified metal or alloy during cooling in the mold.

5 Claims, No Drawings

COMPLAINT INVESTMENT CASTING MOLD AND METHOD

FIELD OF THE INVENTION

The present invention relates to investment casting and, more particularly, to an investment casting mold and method for use in casting high melting point and/or low ductility metals and alloys without hot tearing or cracking of the casting. The present invention also relates more particularly to a ceramic shell mold and method for use in producing single crystal castings of intermetallic alloys.

BACKGROUND OF THE INVENTION

Commercial investment casting typically involves use of a shell mold formed by the "lost wax process" wherein a fugitive pattern of the article to be cast is repeatedly dipped in ceramic slurry and stuccoed to build up the shell mold. The pattern is then removed, and the green mold fired to develop adequate strength for casting. Such shell molds provide good control over casting chemistry, dimensions, heat removal/solidification rates, and cooling stresses. These factors are especially important to directionally solidified and single crystal (DS/SC) castings. To date, most DS/SC castings are made of nickel-based superalloys. Even with various mold materials and casting methods, castings sometimes have hot tearing or hot cracking problems due to excessive shell strength following melt solidification. Furthermore, if a DS/SC casting is excessively stressed during mold removal, it may be subject to cracks or grain recrystallization.

Various mold compositions have been proposed for use in high temperature DS/SC casting processes.

Greskovich (U.S. Pat. No. 4,188,450) and Takayanagi (U.S. Pat. No. 4,664,172) disclose refractory mold compositions of alumina with a silica binder, which form mullite on firing above 1400° C. These molds have only fair sag resistance at intermediate temperatures (1200°-1400° C.) encountered during the DS/SC casting process due to binder softening before the mullite forms. Their excellent hot strength is retained upon cooling from the casting cycle. This can damage the casting on cooling or during shell removal. Furthermore, the silica or mullite is reactive with several common alloying elements. Svec et al. (U.S. Pat. No. 4,247,333) describes removal of the silica from such molds by firing in a reducing atmosphere, but the method disclosed is slow and costly, and does not address the problems of excessive mold strength after casting.

Fassler et al. (U.S. Pat. No. 3,933,190) disclose an all-alumina shell mold bonded by aluminum oxychloride. This shell mold has low green strength, is not suitable for autoclave dewaxing, and requires a high firing temperature prior to use. This shell mold also becomes excessively strong, due to sintering, during exposure to DS/SC casting temperatures.

Feagin (U.S. Pat. Nos. 4,196,769 and 4,216,815) describes a shell mold material with an alumina binder, producing a mold green strength of only about 50% of that of conventional shell molds. Shell mold strength was found to increase with firing temperature such that these shell molds have exhibited excessively high strength following DS/SC casting, possibly leading to casting defects. Shell molds made by this art have not been found to be autoclavable, since the binder swells on exposure to steam.

Mills (U.S. Pat. No. 4,617,977) describes an injection or transfer shaped mold body that is fired to an elevated temperature. This process can yield dimensionally precise, thin walled casting molds. However, the process requires more tooling than a slurry dipped/stuccoed shell mold process. Also, time and equipment intensive firing steps are required. The resulting fine grained mold can have extensive firing shrinkage, and can be too strong to be removed effectively after casting.

In general, nickel aluminide (NiAl) is an intermetallic compound with potential for use in gas turbine engines. In particular, turbine blades and vanes of this material offer significant opportunities for improving gas turbine engine performance. NiAl based alloys exhibit lower densities, higher thermal conductivities, higher melting temperatures, and greater oxidation resistance than the most advanced directionally solidified/single (DS/SC) crystal nickel based superalloys. The NiAl alloys exhibit high melting points which may allow their use at higher operating temperatures than the aforementioned conventional nickel based superalloys.

However, even in alloyed compositions, NiAl has limited ductility, and near zero ductility below the ductile to brittle transition temperature (DBTT) of about 1000° F. Although it is desirable to make net shape single crystal NiAl turbine components by investment casting, conventional mold technology is limited in at least four respects with respect to this material: 1) the molds do not retain dimensional stability at the high (>3000° F.) casting temperatures required for NiAl, 2) the molds have excessive reaction with the NiAl melt and this results in contamination of the casting, 3) the molds may cause hot tearing/hot cracking due to excessive mold strength during cooling, and 4) the molds are difficult to remove without damaging the casting.

For example, current silica bonded ceramic shell mold technology has been unable to yield cast NiAl based alloys without hot tearing and cracking of the casting. In particular, as a result of its high melting temperature (about 2990° F.), low ductility below about 1000° F., and low strength relative to the conventional silica bonded zircon shell mold systems, DS/SC castings of NiAl alloys hot tear and crack during solidification and cooling in the ceramic mold. Moreover, slumping, bulging and even melting of conventional silica bonded zircon molds has occurred during investment casting of NiAl alloys when the mold is exposed to temperatures above 2900° F. for a prolonged time. This behavior is attributed to the relatively low creep strength and of such molds at the casting temperatures involved. Mold slumping, bulging, or melting produces castings which are not dimensionally accurate. Furthermore, prior art workers are concerned about silicon pick-up in the casting using this conventional mold technology.

With respect to current silica bonded alumina shell mold systems, some of the silica binder volatizes during exposure at NiAl casting temperatures and contaminates the furnace atmosphere with silicon. Moreover, silica bonded alumina shell molds become sintered at NiAl alloy casting temperatures and, as a result, become much stronger than the casting. Castings hot tear or crack during cooling in the mold as a result.

Investment casting of NiAl based alloys in conventional silica bonded zircon and alumina mold systems is not viable for producing turbine airfoils (blades and vanes) as a result of the cracking or hot tearing observed. Likewise, sintering of alumina or zirconia bonded shell molds can cause high strengths which lead to cracks in the NiAl castings. While these types of shell molds do not have the problems of slump, limited refractoriness, or contamination of the silica bonded molds, they still present a cracking problem. Also, the green strength of alumina or zirconia bonded shell molds produced by the prior art have been deficient. Moreover, they are easily damaged in handling or from wax expansion stresses, and some of these mold systems can not be autoclave dewaxed. Such disadvantages of alumina or zirconia bonded shell molds detracts from their use as a production mold system.

Various mold systems have been proposed for reducing mold strength after casting solidification.

Watts (U.S. Pat. Nos. 4,533,394 and 4,689,081) discloses an artificial stucco material, comprising a refractory powder and an organic binder. The binder is burned out during mold firing. While this approach would aid shell removal from the solidified casting, it would increase mold shrinkage and reduce mold strength at DS/SC casting temperatures. It also would require extra processing steps in manufacturing the artificial stucco.

Klug et al. (U.S. Pat. Nos. 4,164,424; 4,191,721 and 4,221,748) describe a porous core or mold material produced from a mixture of alumina, an organic binder, and a reactive fugitive filler. These injection molding mixtures are not suitable for shell mold fabrication. The shaped mixtures require carefully controlled firing conditions and have high firing shrinkage. Their porous microstructure is made by reduction and vapor transport of the alumina during sintering. The patent points out that "unbound carbon" should be removed prior to eutectic or superalloy casting.

Lirones (U.S. Pat. No. 3,239,897) discloses a shell mold composition which includes ceramic powders and stuccos, bonded by colloidal graphite. The colloidal graphite could impart easier removal of the mold from the casting and cleaning of the casting than the sodium silicate bonded molds. However, the graphite binder does not exhibit green strength comparable to the silicate binders. The mold is burned out under special conditions (reducing atmosphere). Finally, the use of zircon or silica refractories with a graphite binder would result in significant mold/melt reactions if heated to DS/SC casting temperatures.

Manginelli (U.S. Pat. No. 3,362,463) describes the use of solid or hollow "globules" to reduce the weight and cost of investment molds in flask or shell configurations for making equiaxed grain castings. In the intended application for making equiaxed grain castings, it is unnecessary to preheat the mold to high (>2200° F.) temperatures. Consequently, the patent is not faced with problems of excessive mold sintering, shrinkage, or distortion which accompany higher preheat temperatures. The patent indicates that the large fraction of porosity helps equiaxed castings cool slowly. This would be a detriment in the practice of this invention wherein directionally solidified/single crystal (DS/SC) castings are made. The patent also mentions that "shake out" of the mold with hand or pneumatic hammers would be facilitated; however, the mold is not designed to "collapse" at low stress due to cooling of a solidified DS/SC casting.

Noting the aforementioned limitations of conventional mold technology and its unsuitableness for SC investment casting of brittle intermetallic alloys, it is an object of the present invention to provide mold technology which overcomes these difficulties and is useful in producing sound, crack-free castings, such as DS and SC castings, of intermetallic alloys, superalloys and low ductility materials other than intermetallic alloys and superalloys.

It is another object of the present invention to provide a casting mold, and method of making same, which is useful for investment casting of nickel or titanium aluminide alloys as well as other high melting point, low ductility metals and alloys without hot tearing or cracking during solidification and cooling of the casting in the mold.

It is another object of the present invention to provide a casting mold, and method of making same, for casting nickel aluminide alloys as well as other high melting point and/or low ductility metals and alloys wherein a region of the mold is selectively crushed or deformed as necessary as the casting solidifies and cools in the mold below the metal/alloy ductile-to-brittle transition temperature so as to avoid hot tearing or cracking of the casting by compressive mold stresses.

It is still another object of the present invention to provide a method of casting nickel aluminide alloys as well as other high melting point and/or low ductility metals and alloys without hot tearing or cracking during solidification and cooling of the casting in a ceramic mold.

One particular object of this invention is to provide a shell mold which is capable of enduring a 2700° F+ DS/SC casting cycle without excessive shrinkage or distortion while exhibiting enough mold strength at temperature to hold the molten alloy.

Another particular object is to provide a shell mold which does not increase in strength during a DS/SC casting cycle.

Another particular object is to provide a shell mold which does not induce hot tearing/cracking to castings during cooling from the casting process.

Another particular object is to provide a shell mold which is easily removed from a casting without mechanically or chemically damaging the casting.

Another particular object is to provide a shell mold with sufficient green strength to be handled, dewaxed, and/or fired using production techniques.

Another particular object is to provide a shell mold which is substantially free of silica binder, is amendable to autoclave dewaxing, and exhibits sufficient post-dewax strength for handling and casting, without a high temperature (>2000° F.) sintering cycle.

SUMMARY OF THE INVENTION

The present invention contemplates a refractory casting mold for investment casting a high melting point and/or low ductility metal or alloy wherein the mold includes a refractory facecoat layer for contacting the molten metal or alloy to be cast therein and a plurality of refractory back-up layers formed about the facecoat layer wherein at least one of the back-up layers is a relatively weak, sacrificial layer. The sacrificial mold layer(s) is (are) adapted to be crushed or otherwise deformed as the cast metal or alloy cools in the mold below the metal/alloy ductile-to-brittle transition temperature (DBTT). The sacrificial layer(s) is (are) crushed as necessary to avoid hot tearing or cracking of the solidified metal or alloy during cooling in the mold.

One or more sacrificial layers comprising a graphite-bearing slurry and a crushable constituent thereon, such as, for example, graphite stucco, ceramic beads, and/or voids produced by vaporization of plastic or other vaporizable beads, preferably are used in practicing the invention. Graphite-bearing layers are used since graphite is refractory so that mold slumping or melting is minimized and also acts as a non-sinterable filler which prevents excessive mold strength development at the casting temperature. The low shear strength of the graphite stucco employed in the layers also aids in removal of the mold without cracking of the casting.

The necessary refractoriness for the degradable layers is achieved using high melting ceramic systems, such as alumina or zirconia, in conjunction with the sacrificial, graphite-bearing layers.

Following solidification, the casting and mold cool and shrink at different rates, placing a tensile stress on the casting. The sacrificial layer(s) of the mold is (are) relatively weak compared to other mold layers and are adapted to be selectively crushed as necessary to avoid hot tearing and cracking of the casting. In one embodiment of the invention, the mold facecoat layer typically comprises a primary facecoat layer and one or more secondary facecoat layers, each facecoat layer including a dried ceramic slurry and ceramic stucco on the dried slurry. The graphite-bearing sacrificial layers typically include a dried slurry comprising alumina and graphite particulates and a crushable particulate stucco or constituent applied to the dried slurry and selected from graphite particulates, ceramic beads (e.g., alumina beads), and/or voids produced by vaporization of plastic or other vaporizable beads (e.g., expanded polystyrene beads). As the cast metal or alloy cools in the mold below its DBTT, the sacrificial mold layers are crushed as necessary to avoid hot tearing or cracking of the casting.

The present invention envisions a selectively-crushable mold that can be made substantially silica-free. For example, two non-silica binders with opposing pH values (i.e., one acidic and the other basic) are alternated in the slurry coating process, thereby chemically setting each other and providing good green strength, autoclavability, and handleability. This silica-free mold does not require a high temperature sintering cycle, since the non-silica binders provide adequate strength up to the casting temperature.

A method of making a casting mold in accordance with the invention involves providing a pattern having the shape of a desired casting, forming a refractory facecoat layer on the pattern by, for example, coating the pattern with a ceramic slurry and stuccoing the ceramic slurry with refractory particulates. One or more relatively weak, sacrificial graphite-bearing layers are formed about the facecoat layer by, for example, coating the facecoated pattern with a slurry comprising fine ceramic and graphite particulates and stuccoing the slurry with a crushable constituent until the desired number of sacrificial layers are formed. The sacrificial layers are covered with additional back-up layers, each comprising a dried ceramic slurry and ceramic stucco, until the remaining structural body (shell) of the mold is formed. The pattern is then removed from the mold by methods known to those skilled in the art of investment casting.

The present invention also contemplates a method of casting a high melting point and/or low ductility metal or alloy, such as an intermetallic alloy, wherein a refractory casting mold of the type described is formed having the sacrificial graphite-bearing layer(s), molten metal or alloy is provided in the mold, and the molten metal or alloy is solidified. As the metal or alloy solidifies in the mold and cools below its DBTT, the sacrificial layers are crushed as necessary to avoid hot tearing or cracking of the metal or alloy by tensile stresses on the casting during cooling in the mold. The present invention is especially useful in the casting of directionally solidified and single crystal turbine airfoils (blades and vanes) comprising intermetallic alloys, such as nickel aluminide alloys, without hot tearing or cracking.

The invention may be better understood when considered in light of the following detailed description of certain embodiments thereof.

DETAILED DESCRIPTION OF THE INVENTION

The present invention provides a refractory casting mold, and method of making same, for investment casting a high melting point, low ductility metal or alloy wherein the mold includes facecoat layer and a plurality of back-up layers, at least one of which is a relatively weak, sacrificial layer and constituting a selectively crushable region of the mold wall. The sacrificial layer(s) is (are) adapted to be selectively crushed or otherwise deformed as necessary as the cast metal or alloy cools in the mold below its DBTT to avoid hot tearing or cracking of the casting by tensile stresses on the casting generated during cooling.

In accordance with one embodiment of the invention, such an investment casting mold is formed about a fugitive (removable) pattern having the shape of the cast part desired. For example, in making a turbine blade or vane (airfoil) casting, the pattern will have the configuration of the turbine blade or vane desired. The pattern may be made of wax, plastic or other removable material suitable for use in "lost wax" casting processes. Wax and plastic patterns are typically injection molded to the desired pattern configuration in conventional pattern injection molding machines.

A primary mold facecoat layer for contacting the molten metal or alloy to be cast is first formed on the pattern typically by dipping the pattern in a suitable ceramic slurry (coating), draining excess slurry from the pattern, and then stuccoing the ceramic slurry while wet with relatively coarse ceramic particulates (stucco). One or more secondary facecoat layers may be formed on the primary facecoat layer by repeating the sequence of dipping the pattern in the ceramic slurry, draining excess slurry, and stuccoing the requisite number of times corresponding to the number of layers desired. In this situation, each slurry/stucco layer is dried prior to carrying out the next coating and stuccoing operation. The primary facecoat layer and each secondary facecoat layer, if present, includes an inner region comprising the dried ceramic slurry and outer region comprising the ceramic stucco.

The particular ceramic slurry and ceramic stucco employed for the mold facecoat layer(s) will depend upon the reactivity of the metal or alloy to be cast as well as the casting temperature and residence time of the metal or alloy in the mold needed for solidification and cooling of the casting. For example, directional solidification and single crystal casting processes used to produce turbine blades/vanes require a relatively long residence time of a superheated metal or alloy in the mold to achieve the desired casting microstructure. The ceramic slurry and stucco of the facecoat layer(s) are selected so as to be substantially non-reactive with the molten metal or alloy cast in the mold under the particular casting conditions to be encountered.

For purposes of illustration and not limitation, a mold facecoat for the casting of directionally solidified nickel aluminide alloy blades or vanes comprises first and second alumina based slurry/stucco layers. In particular, a suitable wax blade or vane-shaped pattern is first coated with an aqueous alumina slurry. This slurry comprises fine alumina particulates (alumina flour of −325 mesh size) and a colloidal alumina binder in an aqueous solution. The binder is available under the trademark Bluonic "A" from Wesbond Corporation, Wilmington, Del., and exhibits a relatively low (acidic) pH of about 4.5. The slurry comprises about 75 weight % alumina flour and 25 weight % binder. The stucco comprises alumina particulates having a 70 to 120 mesh size. After the pattern is coated, it is drained of excess slurry, and then the alumina stucco is sprinkled onto the wet slurry remaining on the pattern. The slurry/stucco coated pattern is dried before a second alumina based slurry/stucco is applied.

The second slurry comprises alumina flour (−325 mesh) and a zirconia binder in an aqueous solution. The binder is available under the trademark "Bacote 20" from Magnesium Elektron Inc., Flemington, N.J., and exhibits a relatively high (basic) pH of about 9.0. The slurry comprises about 70 weight % alumina flour and 30 weight % binder. The stucco comprises tabular alumina particulates having a 70 to 90 mesh size. Prior to coating with the second slurry, the dried first slurry/-stucco layer may be pre-wet with the zirconia binder or a dilute form of the second slurry.

After the pattern is coated with the second slurry, it is drained of excess slurry, and then the alumina stucco is sprinkled onto the wet slurry. The slurry/stucco coated pattern is then dried. The total thickness of the mold facecoat (i.e., the first and second slurry/stucco layers) formed in the manner described is approximately 0.040 inch.

The relatively low pH binder (Bluonic "A" binder) used in the first slurry and the relatively high pH binder ("Bacote 20" binder) used in the second slurry set one another after coating to improve the green strength of the shell mold formed about the pattern.

One or more relatively weak, sacrificial back-up layers are then formed on the mold facecoat to form a structural portion or region of the shell mold. The sacrificial layer(s) may comprise a minor or major structural portion of the mold. Typically, the sacrificial layer(s) are covered with further ceramic back-up layers, each comprising a dried ceramic slurry and ceramic stucco, constituting the remaining structural portion of the mold. The sacrificial layers are relatively weak as compared to the other mold back-up layers so as to provide selectively crushable mold region that is crushed as necessary as the metal or alloy solidifies in the mold and cools below its DBTT. This avoids hot tearing or cracking of the solidified metal or alloy from tensile stresses generated during cooling in the mold.

To this end, each sacrificial layer comprises a dried slurry comprising fine ceramic and graphite particles and a crushable particulate stucco applied on the dried slurry and selected from one or more of graphite stucco, hollow ceramic beads, plastic (or other vaporizable) beads that are later vaporized to yield crushable voids, and other non-sintering, crushable materials (i.e., borides, carbides, nitrides, etc.). The dried ceramic/graphite slurry and crushable stucco comprise respective inner and outer regions of each sacrificial layer.

Each relatively weak, sacrificial layer is formed by coating the facecoated pattern with a ceramic/graphite slurry, draining excess slurry from the pattern, and then stuccoing the ceramic slurry while wet with the crushable particulate stucco. The sequence of coating, drainage, and stuccoing is repeated to achieve the desired number of sacrificial layers. Different ceramic/graphite slurries are used to form the layers from the standpoint that one slurry includes a relatively low pH binder (e.g., Bluonic "A" binder) while another slurry includes a relatively high pH binder (e.g., "Bacote 20" binder) in alternating sequence from one degradable layer to the next (e.g., see the Table below) such that the binders will set one another after coating to improve the green strength of the shell mold.

The fine ceramic particulate component of each sacrificial slurry may conveniently comprise the same ceramic material as that used in the slurry (or slurries) applied to the pattern in the facecoat forming operation (e.g., alumina flour in the illustrative example set forth above), although the invention is not so limited. The fine graphite component of the back-up slurry may comprise graphite flour available from Union Carbide Corp. (GP195) and having a −200 mesh size. The slurry may comprise various proportions of the fine ceramic particulates and graphite particulates. For example, the slurry may comprise about 88 weight % ceramic particulates and about 12 weight % graphite particulates. In general, the dried sacrificial slurry comprises 90–50 weight % ceramic particulates and 10–50 weight % graphite particulates.

The crushable constituent employed typically comprises relatively coarse particulates or stucco. For example, graphite stucco usable as the crushable graphite stucco (Table 1) comprises graphite particulates of about 14 to about 28 mesh size and is available from Union Carbide (GP BB-6), Chicago, Ill. Ceramic beads usable as the crushable stucco comprise hollow alumina beads of 14 to 28 mesh size (Table 1) and are available from Norton Company, Worchester, Mass. Plastic beads usable to generate crushable voids comprise expanded polystyrene beads (Table 1) of 14 to 28 mesh size and are available from Arco Chemical, Monaco, Pa. The expanded polystyrene beads are subsequently vaporized to leave voids at the sacrificial layer.

After the pattern is coated, it is drained of excess slurry, and then the crushable stucco or constituent is sprinkled onto the wet slurry remaining on the pattern. The slurry/stucco coated pattern is then dried prior to application of the slurry/stucco layer for the next sacrificial or back-up layer.

For purposes of further illustration and not limitation, sacrificial layers for use with the mold facecoat described above (i.e., first and second alumina based slurry/stucco layers) for the casting of DS/SC nickel aluminide alloy blades or vanes airfoils are formed from the slurry/binder/stucco combinations set forth in the Table 1 below.

TABLE 1

Dip Sequences for Compliant Mold Systems[1, 2]

| Dip No. | A | B | C | D |
|---|---|---|---|---|
| 1 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 2 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 3 | $Al_2O_3$—Gr/BluA/Gr | $Al_2O_3$—Gr/BluA/Gr | $Al_2O_3$—Gr/BluA/Gr | $Al_2O_3$—Gr/BluA/Gr |
| 4 | $Al_2O_3$—Gr/Bac/Gr | $Al_2O_3$—Gr/Bac/Gr | $Al_2O_3$/Bac/$Al_2O_3$ | $Al_2O_3$—Gr/Bac/Gr |
| 5 | $Al_2O_3$—Gr/BluA/Gr | $Al_2O_3$—Gr/BluA/Gr | $Al_2O_3$/BluA/$Al_2O_3$ | $Al_2O_3$/BluA/$Al_2O_3$ |
| 6 | $Al_2O_3$—Gr/Bac/$Al_2O_3$ | $Al_2O_3$/Bac/Gr | $Al_2O_3$/Bac/$Al_2O_3$ | $Al_2O_3$/Bac/$Al_2O_3$ |
| 7 | $Al_2O_3$—Gr/BluA/$Al_2O_3$ | $Al_2O_3$—Gr/BluA/$Al_2O_3$ | $Al_2O_3$/BluA/$Al_2O_3$ | $Al_2O_3$/BluA/$Al_2O_3$ |
| 8 | $Al_2O_3$/Bac/cover | $Al_2O_3$/Bac/$Al_2O_3$ | $Al_2O_3$/Bac/cover | $Al_2O_3$/Bac/cover |
| 9 | — | $Al_2O_3$/BluA/cover | — | — |
| | **E** | **F** | **G** | **H** |
| 1 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 2 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 3 | $Al_2O_3$/BluA/$Al_2O_3$beads | $Al_2O_3$/BluA/$Al_2O_3$beads | $Al_2O_3$/BluA/$Al_2O_3$beads | $Al_2O_3$/BluA/$Al_2O_3$beads |
| 4 | $Al_2O_3$—Gr/Bac/Gr | $Al_2O_3$—Gr/Bac/Gr | $Al_2O_3$—Gr/Bac/$Al_2O_3$ | $Al_2O_3$/Bac/$Al_2O_3$ |
| 5 | $Al_2O_3$—Gr/BluA/Gr | $Al_2O_3$/BluA/$Al_2O_3$beads | $Al_2O_3$—Gr/BluA/$Al_2O_3$beads | $Al_2O_3$/BluA/$Al_2O_3$ |
| 6 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 7 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 8 | $Al_2O_3$/Bac/cover | $Al_2O_3$/Bac/cover | $Al_2O_3$/Bac/cover | $Al_2O_3$/Bac/cover |
| | **I** | **J** | **K** | **L** |
| 1 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 2 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 3 | $Al_2O_3$—Gr/BluA/EPS beads | $Al_2O_3$—Gr/BluA/EPS beads | $Al_2O_3$—Gr/BluA/EPS beads | $Al_2O_3$/BluA/EPS beads |
| 4 | $Al_2O_3$—Gr/Bac/Gr | $Al_2O_3$—Gr/Bac/Gr | $Al_2O_3$—Gr/Bac/$Al_2O_3$ | $Al_2O_3$/Bac/$Al_2O_3$ |
| 5 | $Al_2O_3$—Gr/BluA/Gr | $Al_2O_3$—Gr/BluA/$Al_2O_3$beads | $Al_2O_3$—Gr/BluA/$Al_2O_3$beads | $Al_2O_3$/BluA/$Al_2O_3$ |
| 6 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 7 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 8 | $Al_2O_3$/Bac/cover | $Al_2O_3$/Bac/cover | $Al_2O_3$/Bac/cover | $Al_2O_3$/Bac/cover |

[1]dip layers indicated as slurry/binder/stucco
[2]where "BluA" is Bluonic "A", "Bac" is Bacote 20, and "Gr" is graphite In particular, the facecoated wax pattern is first coated in an alumina/graphite slurry. The slurry comprises fine alumina particulates (alumina flour of −325 mesh size), fine graphite particulates (graphite flour of −200 mesh), and an alumina sol binder ("Bluonic "A" binder described above) in an aqueous solution. The slurry comprises about 72 weight % alumina and graphite particulates (88 weight % alumina flour and about 12 weight % graphite flour) and 28 weight % "Bluonic "A" binder. After the facecoated pattern is coated, it is drained of excess slurry, and then the stucco identified in Table 1 is sprinkled on the remaining wet slurry. The slurry/stucco coated pattern is dried before the next slurry/stucco is applied.

The pattern is then coated in a similar slurry with the exception that a zirconia sol binder ("Bacote 20" binder described above) is used in lieu of the alumina sol binder. The slurry comprises about 65 weight % alumina and graphite flour (88 weight % alumina flour and 12 weight % graphite flour) and 35 weight % "Bacote 20" binder. After the pattern is coated, it is drained of excess slurry, and then the crushable stucco listed in Table 1 is sprinkled onto the wet slurry. The slurry/stucco coated pattern is then dried before the next slurry/stucco is applied.

This coating/stuccoing sequence is repeated as shown in Table 1 to produce a green shell mold having sacrificial layers covered by back-up layers as indicated in the Tables. The relatively low pH "Bluonic "A" binder and the relatively high pH "Bacote 20" binder used in the alternating mold layers set one another to improve the green strength of the shell mold formed. The last slurry layer is a cover or seal layer.

The total thickness of the sacrificial and additional back-up layers (layers #3–8 or 9) formed in the manner described is approximately 0.25 inches providing a total shell mold wall thickness of approximately 0.29 inches.

After the desired green shell mold is built up on the pattern, the mold is thoroughly dried and the pattern is removed therefrom. Conventional techniques, such as melting, dissolution, and/or ignition, may be used to remove the pattern from the shell mold. The mold is further burned out in air at a low temperature (<1850° F.) for a time sufficient to remove residual pattern material and traces of water. If expanded polystyrene beads have been used as stucco in forming the sacrificial layer(s), they will be vaporized at this stage so as to leave a sacrificial layer including voids that render the layer crushable during cooling of the casting in the mold.

The fired shell mold can then be used in the investment casting of a high melting point, low ductility metal or alloy, including an intermetallic alloy such as NiAl in the aforementioned illustrative example. Prior to casting, however, the shell mold may be preheated to a suitable elevated temperature under vacuum depending on the metal or alloy to be cast to insure that it is effectively free from moisture and to promote satisfactory filling of the molten metal or alloy in all locations of the mold. For directional solidification and single crystal casting processes, the shell mold is preheated to an elevated temperature to promote development of the desired directional or single crystal grain microstructure.

For purposes of illustration, the shell mold formed in the manner described above and in the Table is first heated to 1500° F. for 15 minutes in air to remove the pattern. No high temperature sintering treatment is required since the alumina and zirconia binders provide adequate strength up to the casting temperature. The fired shell mold is then placed in a casting furnace of a surrounding casting chamber and preheated under vacuum to a temperature of about 2600° F. The chamber is then backfilled to 0.8 atmosphere argon. The mold and a quantity of NiAl alloy (e.g., 31.9 weight % Al and balance Ni) disposed in a crucible above the mold in the casting furnace and are further heated to 3125° F. in the casting furnace. The molten NiAl alloy melts in the crucible and flows into the preheated shell mold. The alloy is then directionally solidified by the "withdrawal" (Bridgeman) technique, wherein the melt-filled mold is withdrawn from the casting furnace into the casting chamber at a suitably slow rate.

As the molten metal or alloy solidifies and cools below its DBTT, the relatively weak, sacrificial mold layer(s) is (are) crushed and prevent hot tearing or cracking of the casting during subsequent cooling. Turbine blade castings directionally solidified in shell molds of the type identified above as A, B, C, F, H, J, K and L in the illustrative example were found to be free of hot tearing and cracking, with the exception of the turbine blade castings identified as D. The casting produced in this mold exhibited cracking only in the ramp region below the airfoil of the casting. Molds identified as E, G and I in Table 1 were not successfully filled because the alloy did not melt properly and could not be introduced into the mold.

As mentioned hereinabove, the sacrificial layer comprises a graphite-bearing layer (e.g., including the dried alumina/graphite slurry) and a crushable constituent thereon. Referring to Table 2, casting molds made without the graphite-bearing layer are described. These molds were made in the manner and from the materials described above and cast with nickel aluminide in the manner also described hereinabove.

TABLE 2

| Dip No. | Sequences for Mold Systems Without Graphite | | | | |
|---|---|---|---|---|---|
| | M | N | O | P | Q |
| 1 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ |
| 2 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 3 | $Al_2O_3$/BluA/$Al_2O_3$ | $Al_2O_3$/BluA/EPS beads | $Al_2O_3$—Gr/BluA/$Al_2O_3$ EPS beads | $Al_2O_3$/BluA/EPS beads | $Al_2O_3$/BluA/$Al_2O_3$beads |
| 4 | foam | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 5 | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$ | $Al_2O_3$/BluA/$Al_2O_3$beads |
| 6 | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ | $Al_2O_3$/Bac/$Al_2O_3$ |
| 7 | $Al_2O_3$/BluA/cover | $Al_2O_3$/BluA/cover | $Al_2O_3$/BluA/cover | $Al_2O_3$/BluA/$Al_2O_3$ | $Al_2O_3$/BluA/$Al_2O_3$ |
| 8 | — | — | — | $Al_2O_3$/Bac/cover | $Al_2O_3$/Bac/cover |

[1]dip layers indicated as slurry/binder/stucco
[2]where "BluA" is Bluonic "A", "Bac" is Bacote 20, and "Gr" is graphite All of the turbine blade castings produced in these molds exhibited cracking after cooling to ambient temperature. These results contrast to the crack-free castings produced when the sacrificial layer includes a graphite-bearing layer and a crushable constituent, see Table 1.

Following cooling of the casting to ambient temperature and removal from the casting chamber, the shell mold is removed from the casting by caustic salt bath or light grit blast or hand knockout. The shell mold may also be removed from the casting by other shell mold removal techniques, such as water blasting.

Although the present invention has been described in terms of certain embodiments thereof, the invention is not limited thereto. For example, the invention also contemplates other embodiments in which other refractory mold materials may be used for the sacrificial layers. These materials can include the use of other crushable, non-sintering materials (e.g., borides, carbides, nitrides, etc.). These materials would be crushed or otherwise deformed as the casting cools below its DBTT to prevent hot tearing or cracking.

The above description relates to preferred embodiments of the invention. However, alternative configurations and modifications are possible within the scope of the invention. Therefore, the subject matter of the invention is to be limited only by the following claims and their equivalents.

While the present invention is useful in casting nickel aluminides, it is envisioned that other relatively brittle materials could be cast into airfoil or other shapes using the invention. These materials include, but are not limited to, other aluminides (i.e., titanium, niobium, cobalt, etc.), silicides, and other high melting point, low ductility intermetallic compounds and alloys.

While it is desirable to practice this invention with non-silica refractory compositions, it is envisioned that less reactive or lower melting metal alloys could be advantageously cast as described herein, even if silica containing slurries or stuccos are used. Furthermore, it is preferable in practicing the invention to alternate the low and high pH non-silica binder systems throughout the layers in the shell molds. However, it is possible to make adjacent layers of the shell with the same binder system, but this has generally lead to less favorable results due to lower mold strengths. Likewise, various refractory powders could be used in the shell mold of this invention. The examples set forth above employed alumina powders due to their low cost and availability.

We claim:

1. A method of casting one of a high melting point metallic material and a low ductility metallic material, comprising:

a) providing a refractory mold having a mold cavity for receiving molten metallic material and having a facecoat layer and a plurality of back-up layers about said facecoat layer wherein at least one of the back-up layers is a relatively weak sacrificial layer that comprises a bonded graphite-bearing layer and a crushable constituent about the graphite-bearing layer and that is deformable proximate the ductile-to-brittle transition temperature of said metallic material, b) providing molten metallic material in the mold, c) solidifying the molten metallic material in the mold, and d) as the metallic material solidifies in the mold and cools below its ductile-to-brittle transition temperature, selectively deforming the relatively weak sacrificial layer to avoid hot tearing or cracking of the solidified metallic material during cooling in the mold below said ductile-to-brittle transition temperature.

2. The method of claim 1 wherein the graphite-bearing layer comprises a dried graphite-bearing slurry.

3. The method of claim 2 wherein the crushable constituent is selected from the group consisting of coarse graphite particulates in a size range of 14 to 28 mesh, hollow ceramic beads, and voids produced by vaporization of vaporizable beads.

4. A method of casting an intermetallic alloy, comprising:

a) providing a refractory casting mold including a mold cavity for receiving molten intermetallic alloy and including a facecoat layer and a plurality of back-up layers about said facecoat layer where at least one of the back-up layers is a relatively weak sacrificial layer that comprises an inner region including ceramic particulates and graphite particulates bonded together and an outer region including a crushable constituent and that is deformable proximate the ductile-to-brittle transition temperature of said intermetallic alloy, b) providing molten intermetallic alloy in the mold, c) solidifying the molten intermetallic alloy in the mold, and d) as the intermetallic alloy solidifies in the mold and cools below its ductile-to-brittle transition temperature, crushing the sacrificial layer to avoid hot tearing or cracking of the solidified intermetallic alloy during cooling in the mold below said ductile-to-brittle transition temperature.

5. A method of casting nickel or titanium aluminide alloy, comprising:

a) providing a refractory casting mold including a mold cavity for receiving molten alloy and including 1) a facecoat layer comprising a dried ceramic slurry and ceramic particulate stucco thereon, and 2) a plurality of back-up layers about the facecoat layer wherein at least one of the back-up layers is a relatively weak sacrificial layer that comprises a dried slurry including ceramic particulates and graphite particulates bonded together and a crushable constituent about the dried slurry and that is deformable proximate the ductile-to-brittle to transition temperature of said alloy, b) providing molten nickel or titanium aluminide alloy in the mold, c) solidifying the molten nickel or titanium aluminide alloy in the mold, and d) as the nickel or titanium aluminide alloy solidifies in the mold and cools below its ductile-to-brittle transition temperature, crushing the sacrificial layer to avoid hot tearing or cracking by compressive mold stress present during cooling of the solidified nickel or titanium aluminide alloy below said ductile-to-brittle transition temperature.

* * * * *